United States Patent [19]

Collette

[11] Patent Number: 4,947,767

[45] Date of Patent: Aug. 14, 1990

[54] DUAL CHAMBER VOLATILIZATION SYSTEM

[76] Inventor: Jerry R. Collette, P.O. Box 1482, Englewood, Fla. 34295-1482

[21] Appl. No.: 465,024

[22] Filed: Jan. 16, 1990

Related U.S. Application Data

[62] Division of Ser. No. 295,055, Jan. 6, 1989.

[51] Int. Cl.[5] ..... F23B 5/00

[52] U.S. Cl. ..... 110/212; 110/214; 110/246; 432/106

[58] Field of Search ..... 110/210–215, 110/246; 432/106

[56] References Cited

U.S. PATENT DOCUMENTS

| | | | |
|---|---|---|---|
| 3,267,890 | 8/1966 | Zinn et al. | 110/214 |
| 4,038,032 | 7/1977 | Brewer et al. | 110/212 |
| 4,153,411 | 5/1979 | Isheim | 110/246 |
| 4,245,571 | 1/1981 | Przewalski | 110/212 |
| 4,304,550 | 12/1981 | Heian | 432/106 |
| 4,667,609 | 5/1987 | Hardison et al. | 110/241 |
| 4,738,206 | 4/1988 | Noland | 110/346 |
| 4,859,177 | 8/1989 | Kreisberg et al. | 432/106 |

*Primary Examiner*—Henry C. Yuen

*Attorney, Agent, or Firm*—Charles J. Prescott; Raymond H. Quist

[57] ABSTRACT

A system for removing volatilizable organic contaminants from solid materials has a primary volatilizer and a secondary volatilizer positioned in series. A charging system continuously loads solid materials which have been blended to contain a predetermined concentration of contaminants into the primary volatilizer. A portion of the contaminants are volatilized in the primary volatilizer. The solid materials and the volatilized contaminants are transfered to the secondary volatilizer where the volatilized contaminants are burned to provide heat for help in volatilizing the remainder of the contaminants. The solid material which is now decontaminated is quenched. The gases are treated to convert the remaining volatilized contaminants to harmless gases and water vapor. Particulate material is removed from the gases. Nitrogen oxides and sulpher are also converted to harmless forms.

4 Claims, 2 Drawing Sheets

DUAL CHAMBER VOLATILIZATION SYSTEM

This is a divisional of co-pending application Ser. No. 07/295,055 filed on 1/6/89.

BACKGROUND OF THE INVENTION

1. Field of the Invention

This invention relates generally to the removal of contaminants from soil, sand, etc., and more particularly to improved volatilization equipment.

2. Description of Related Art

A vast number of sites have been identified in which the soil has been contaminated by gasoline leaking from underground tanks, dumped oil or other sources. It is recognized that these contaminants will eventually make their way to the ground water. To reduce this source of water pollution, large quantities of soil containing these contaminants must be removed and either treated to remove the contaminants or stored safely. Storing such soil can be no more than a temporary expedient.

My previous invention entitled "Reflux Volatilization System", S.N. 07/194,203, filed May 16, 1988, was an effective and economical system for removing volatilizable contaminants from soil. Further consideration of this problem has resulted in a system having enhanced capability. One area which is improved pertains to the logistics of such a system. Because the system feeds back heat produced during decontamination to decrease the use of fuel for heating, it is most efficiently run as a continuous operation. The soil or other material which is to be treated is typically delivered to the treatment site by trucks which do not always arrive on a regular and predictable basis. Therefore, the addition of large capacity holding bins permits the system to be operated continuously even when the trucks experience long delays.

A second major area of improvement relates to the volatilizer. In the previous system, a counterflow arrangement was used in which hot gases were introduced at one end of a volatilizer and the unheated soil was introduced at the other end. In the present system, two volatilizers arranged in series are used, with the second volatilizer burning at least seventy five per cent of the vaporized hydrocarbons released in the first volatilizer.

SUMMARY OF THE INVENTION

Soil, sand, or the like which is contaminated by liquid hydrocarbons or other objectionable matter in liquid form is delivered by trucks to a crusher hopper and, after passing through a crusher, to one of two large capacity holding hoppers depending upon whether the material has a high or low concentration of contaminants. There are four charging hoppers. One charging hopper contains limestone, one hopper holds high contaminant containing material and two hoppers hold low contaminant containing material. Measurements are made of the concentration of the contaminants and a blend of the high and low concentration materials is made along with a measured quantity of limestone.

The mixture is introduced into a primary volatilizer. The primary volatilizer is preferably one in which hot fluid is used in an indirect heat exchanger in addition to reflux gas which is passed in direct heat exchange with the contaminated soil. In an alternate embodiment the primary volatilizer may be a rotary volatilizer of the same type as that described in my previously referred to invention disclosure.

The soil and the volatilized contaminants are then transfered to a secondary volatilizer in which the remaining organic contaminants are volatilized. Heat for the secondary volatilizer is partially supplied by a burner having a fuel and oxidizer supply, but is supplemented by the burning of the volatilized contaminants from the primary volatilizer. Volatilizable contaminants have now been removed from the soil which is quenched to cool it.

The gases are then subjected to treatment to oxidize any remaining unoxidized organics, change nitrogen oxides to harmless inert forms and remove entrained dust.

It is an object of this invention to provide a system for treating soil which contains liquid contaminants so as to remove these contaminants.

It is also an object of this invention to volatize the liquid contaminants and convert the volatilized contaminants to harmless gases.

It is a further object of this invention to remove particulate material from the harmless gases.

In accordance with these and other objects, which will become apparent hereafter, the instant invention will now be described with reference to the accompanying drawings.

DETAILED DESCRIPTION OF THE INVENTION

Figure 1:
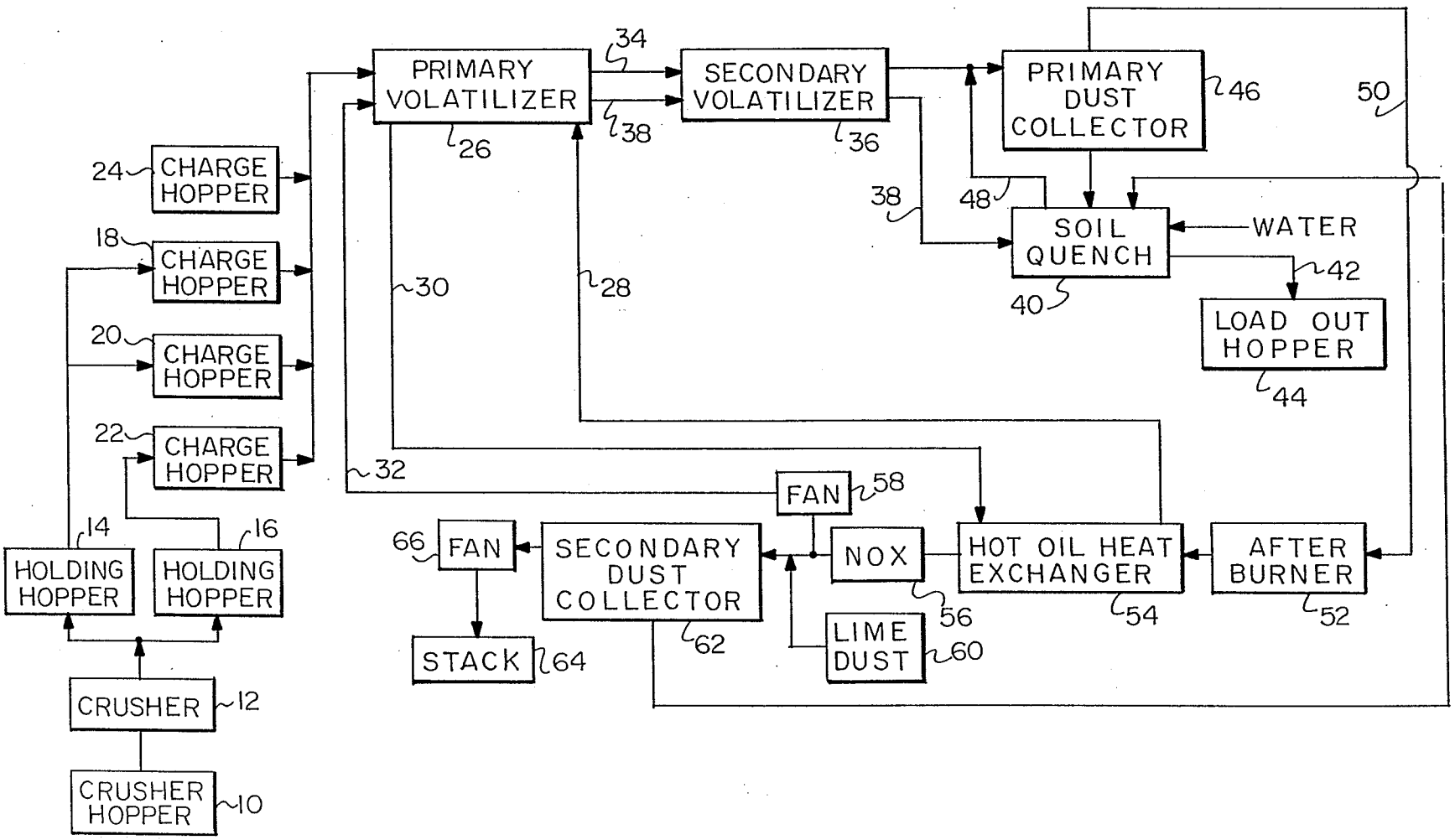
FIG. 1 is a block diagram of a preferred embodiment of a system in accordance with the invention.

Referring to FIG. 1, the contaminated material is delivered to crusher hopper 10 by trucks and is then fed to crusher 12. Crusher 12 assures that none of the material will have a major dimension greater than three quarters of an inch. From crusher 12 the material is delivered to one of two holding hoppers 14 and 16. Holding hopper 14 receives material which has a relatively low concentration of contaminants, while holding hopper 16 receives the material with higher concentrations of contaminants. Holding hoppers 14 and 16 have large capacities so they can serve as buffers between the irregular arrival of trucks loaded with contaminated material, and the regular processing of the material in the remainder of the system.

The material from holding hopper 14 is delivered, as needed, to charge hoppers 18 and 20. The material from holding hopper 16 is delivered, as needed, to charge hopper 22. Additional charge hopper 24 is used to contain clean crushed limestone. A blend of material from charge hoppers 18–24 is fed to primary volatilizer 26. The material is blended to contain approximately 7500 ppm of volatilizable organic contaminants, V.O.C. In the preferred embodiment, primary volatilizer 26 is a commercially available indirect heat exchanger having the trademark TORUSDISC, which is produced by Bepex Corporation, a division of Berwind Corporation of Chicago, Ill. The model selected for this system has a capacity of 120 tons per hour of contaminated material having a maximum size of three quarters of an inch. Hot oil (650 degree F.) is delivered to primary volatilizer 26 in line 28. The oil passes in a convoluted path inside a series of rotating disks, while the material moves slowly through the heat exchanger from the inlet at one end to the outlet at the other end. The oil leaves primary volatilizer 26 in line 30. In addition, to the indirect heating by the oil, hot gas is delivered to primary volatilizer 26 in line 32. This gas is about 350 degrees F. and is further heated by a burner at the inlet end of primary volatilizer 26 so that gas at 750 to 950 degrees F. flows into primary volatilizer 26 for direct contact with the contaminated material. This inert gas dilutes any oxygen within the primary volatilizer to avoid having an explosive gas mixture therein. The reflux gas also helps to flush out the volatilized contaminants from the primary volatilizer as they are released.

The gas leaves primary volatilizer 16 at about 400 degrees F. and is conveyed in line 34 to the inlet of secondary volatilizer 36. A separate conveyor 38 moves the solid material to secondary volatilizer 36. Secondary volatilizer 36 includes a burner at its inlet end and receives both fuel and oxidizer. Sufficient oxidizer is provided to burn most of the volatilized gases which were produced in the primary volatilizer. Secondary volatilizer 36 may be of the type described in my previously referred to system.

Conveyor 38 moves the material from which the contaminants have been removed from the outlet of the secondary volatilizer to soil quench unit 40. The temperature of this material is reduced from about 780 degrees F. to 200 degrees F. in soil quench unit 40 by being sprayed with water. The solid material is moved on conveyor 42 to load out hopper 44. The gas from the outlet of secondary volatilizer 36 is conveyed to primary dust collector along with steam derived from soil quench unit 40 on line 48. Primary dust collector 46 is an inertial type separator such as a cyclone and it removes most of the entrained particulate material from the gas. This dust is moved into soil quench unit 40.

The gas moves through line 50 to after burner 52. After burner 52 uses methanol as a fuel and is supplied with sufficient excess oxidizer to completely oxidize all remaining volatilized organic contaminants. After burner 52 and the other burners used are available from North American Manufacturing, Inc. of Cleveland, Ohio. The products of combustion are delivered to hot oil heat exchanger 54. Heat exchangers of this type are available from Thermiflux Corporation. The hot oil, as previously described, is circulated through primary volatilizer 26.

The gas next is passed through nitrogen oxides selective catalyst reduction unit 56 which has an ammonia injection and converts the nitrogen oxides to harmless water vapor, carbon dioxide, oxygen and nitrogen. This unit is available from Kleenaire Corporation of Lafayette, Louisiana. A portion of the gas from NOX unit 56 is used as reflux gas and introduced into primary volatilizer 26 propelled by fan 58. The remainder of the gas has lime dust added from lime dust unit 60 to react with sulpher in the gas and passes through secondary dust collector 62, which may be a bag house, to remove any remaining dust. This dust is returned to soil quench unit 40 while the gas exits through stack 64 propelled by fan 66.

It should be recognized that the system of FIG. 1 is designed to satisfy the most rigid air pollution standards. In California the South Coast Air Quality Management Division required the use of after burner 52 to assure that no hydrocarbons would be released.

Figure 2:
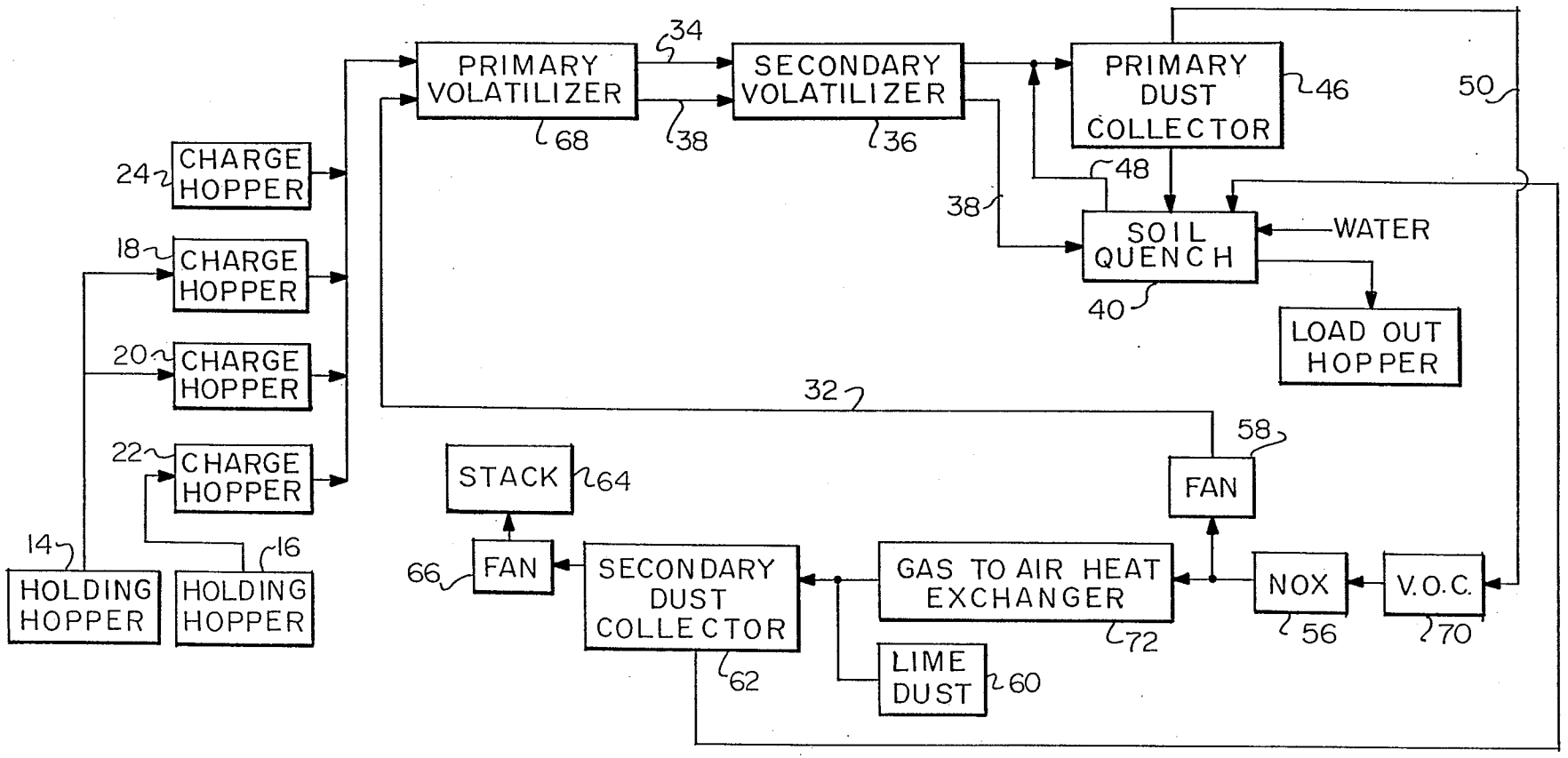
FIG. 2 is a block diagram of another embodiment of a system in accordance with the invention.

In FIG. 2 the same identifying numbers as those in FIG. 1 have been used to identify the same components. In this embodiment of the invention no crusher is used. Contaminated material is dumped directly into holding hoppers 14 and 16. The material is moved through the system at the same rate of 120 tons per hour and is again blended to contain approximately 7500 ppm of volatilizable organic contaminants. Primary volatilizer 68 has a furnace at the inlet end which receives fuel and oxidizer to provide heat for volatilizing the contaminants in the contaminated material. Reflux gas is also delivered over line 32 to provide additional heat. The system is then the same until gas including the remaining volatilized contaminants leaves primary dust collector 46. This gas is conveyed in line 50 to V.O.C. unit 70. V.O.C. unit 70 is a volatilizable organic contaminant catalytic destruction grid manufactured by The Englehard Corporation. The grid has a platinum catalyst which causes the hydrocarbons to react to form harmless gases and water vapor without combustion. A rise in temperature does occur, however. V.O.C. unit 70 will eliminate about 97 per cent of the remaining hydrocarbons. The 3 per cent remaining hydrocarbons are permissible in most areas of the country.

The gas then passes through NOX unit 56 which was previously described. A portion of the gas constitutes the reflux gas, while the remainder is delivered to gas to air heat exchanger 72, where it is cooled to about 350 degrees F. before it enters secondary dust collector 62.

While the instant invention has been shown and described herein in what are conceived to be the most practical and preferred embodiments, it is recognized that departures may be made therefróm within the scope of the invention, which is therefore not to be limited to the details disclosed herein, but is to be afforded the full scope of the claims so as to embrace any and all equivalent apparatus and articles.

What is claimed:

1. A system for removing volatilizable organic contaminants from solid materials comprising:

a primary volatilizer having an inlet end and an outlet end;

a first reflux gas line connected to said primary volatilizer inlet end;

a hot oil heat exchanger having a hot oil outlet and an oil inlet;

a hot oil line connected to supply hot oil from said hot oil heat exchanger hot oil outlet to said primary volatilizer outlet end for indirect heating of solid materials without combustion of said materials;

a return oil line connected to return oil from said primary volatilizer inlet end to said hot oil heat exchanger oil inlet;

said primary volatilizer having a gas outlet at said outlet end;

said inlet end of said primary volatilizer having an inlet for solid materials having volatilizable organic contaminants therein;

a secondary volatilizer having an inlet end and an outlet end;

said secondary volatilizer having a gas inlet at said inlet end and a gas outlet at said outlet end;

said secondary volatilizer having a furnace disposed at said inlet end;

said furnace having a burner having inlets for fuel and oxidizer;

said outlet end of said primary volatilizer connected to deliver solid material to said inlet end of said secondary volatilizer;

said gas outlet of said primary volatilizer connected to deliver gas to said gas inlet of said secondary volatilizer;

said hot oil heat exchanger having a gas inlet and a gas outlet;

a second reflux gas line connected to deliver reflux gas from said secondary volatilizer to said gas inlet of said hot oil heat exchanger;

said gas outlet of said hot oil heat exchanger connected to said first reflux gas line to said primary volatilizer inlet end.

2. A system for removing volatilizable organic contaminants from solid materials in accordance with claim 1 further including:

a primary dust collector having a gas inlet connected to receive reflux gas from said outlet end of said secondary volatilizer;

said primary dust collector having a gas outlet connected to deliver reflux gas to said hot oil heat exchanger gas inlet; said primary dust reflector having a dust outlet.

3. A system for removing volatilizable organic contaminants from solid materials in accordance with claim 1 further including:

an after burner connected to receive reflux gas and oxidize volatilized contaminants contained therein;

said after burner having a gas outlet connected to deliver reflux gas to said hot oil heat exchanger gas inlet.

4. A system for removing volatilizable organic contaminants from solid materials in accordance with claim 1 further including:

a nitrogen oxides catalytic reduction unit connected to receive gas from said gas outlet of said hot oil heat exchanger;

said nitrogen oxides catalytic reduction unit having a gas outlet.

* * * * *